US007240510B2

(12) United States Patent
Lee et al.

(10) Patent No.: US 7,240,510 B2
(45) Date of Patent: Jul. 10, 2007

(54) REFRIGERATOR

(75) Inventors: Myung Ryul Lee, Seongnam-si (KR); Sung Hoon Chung, Seoul (KR); Seong Jae Kim, Ansan-si (KR); Chang Ho Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 129 days.

(21) Appl. No.: 11/043,045

(22) Filed: Jan. 27, 2005

(65) Prior Publication Data

US 2005/0160756 A1 Jul. 28, 2005

(30) Foreign Application Priority Data

Jan. 28, 2004 (KR) ..... 10-2004-0005379

(51) Int. Cl.
*F25C 1/12* (2006.01)

(52) U.S. Cl. ..... 62/353; 62/419

(58) Field of Classification Search ..... 62/344, 62/351, 353, 414, 419, 440, 441
See application file for complete search history.

(56) References Cited

U.S. PATENT DOCUMENTS 3,025,679 A * 3/1962 Keighley ..... 62/71
3,151,472 A * 10/1964 Harle et al. ..... 62/391
3,568,465 A * 3/1971 Jung ..... 62/419
3,788,089 A 1/1974 Graves
3,789,620 A * 2/1974 Benasutti et al. ..... 62/344
4,003,214 A 1/1977 Schumacher
4,872,317 A 10/1989 Reed
5,211,462 A 5/1993 Bien et al.
5,375,432 A 12/1994 Cur
6,945,068 B2 9/2005 Kim et al.
7,076,967 B2 * 7/2006 Lee et al. ..... 62/353
2004/0237565 A1 12/2004 Lee et al.
2005/0061016 A1 3/2005 Lee et al.

* cited by examiner

*Primary Examiner*—William E. Tapolcai
(74) *Attorney, Agent, or Firm*—Birch, Stewart, Kolasch & Birch, LLP

(57) ABSTRACT

There is provided a refrigerator. In the refrigerator, a blower fan is installed in a refrigerant body to blow a cold air, a barrier partitions an inner space of the refrigerator body into a freezing chamber and a chilling chamber, an ice machine is installed in the chilling chamber, a freezing air duct is connected with the ice machine for passing the cold air blown by the blower fan, a chilling air duct is connected with the chilling chamber for passing the cold air blown by the blower fan, and a cold air return duct is provided to pass the cold air discharged from the ice machine toward an evaporator where the cold air is cooled by exchanging heat with a refrigerant.

17 Claims, 11 Drawing Sheets

REFRIGERATOR

BACKGROUND OF THE INVENTION

1. Field of the Invention

The present invention is related to a refrigerator, and more particularly, to a top mount refrigerator in which an ice machine is installed inside a chilling chamber door, and a cold air circulation passage is defined to supply cold air for the ice machine to freeze water in the ice machine quickly.

2. Description of the Related Art

A refrigerator is an electrical appliance for cooling or freezing food to preserve the food. The refrigerator carries out a refrigeration cycle using a compressor, a condenser, an expansion valve, and an evaporator to produce a cold air to store the food. The refrigerator can be classified into a top mount refrigerator in which a freezing chamber and a chilling chamber are partitioned up and down, a bottom freezer refrigerator in which a freezing chamber and a chilling chamber are partitioned down and up, and a side-by-side refrigerator in which a freezing chamber and a chilling chamber are partitioned left and right.

Among the different types of refrigerators, the top mount refrigerator will be described in detail.

The top mount refrigerator includes: a refrigerator body partitioned by a barrier to define the freezing chamber and chilling chamber; a freezing chamber door for opening and closing the freezing chamber; a chilling chamber door for opening and closing the chilling chamber; an ice maker installed in the freezing chamber for freezing water; an ice bank for collecting ice that is ejected from the ice maker; and a compressor, a condenser, an expansion valve, and an evaporator for the refrigeration cycle.

Further, the refrigerator includes cold air inflow ducts and holes at its back for supplying a cold air produced by the refrigeration cycle to the freezing and chilling chambers.

A circulation air cooled by a refrigerant at the evaporator is blown from the evaporator by a blower fan. The blown air is selectively guided to the freezing chamber and chilling chamber.

The cooled air arrived at the freezing chamber flows through the ice maker to freeze the water in the ice maker.

A refrigerator having the circulation air passage structure is disclosed in U.S. Pat. No. 6,675,604, filed on Feb. 27, 2003 by the applicant of the present invention and entitled "COOLING AIR PASSAGE APPARATUS OF REFRIGERATOR".

However, the ice maker of the top mount refrigerator is accommodated in the freezing chamber, such that there is no sufficient room in the freezing chamber for other components and the user, thereby decreasing available interior volume of the refrigerator.

Further, the ice maker in the freezing chamber of the top mount refrigerator is not convenient for short persons, for example, children to take ice out of the ice maker (ice bank). Sometimes, the short persons have to use a chair or the like to take out the ice and this may causes an accident.

SUMMARY OF THE INVENTION

Accordingly, the present invention is directed to a refrigerator that substantially obviates one or more problems due to limitations and disadvantages of the related art.

An object of the present invention is to provide a refrigerator, in which an ice machine is installed inside a chilling chamber door, such that short persons can easily take out ice from the refrigerator.

Another object of the present invention is to provide a refrigerator, in which an ice machine is installed inside a chilling chamber door instead of a freezing chamber, such that a sufficient room can be provided for the freezing chamber.

A further another object of the present invention is to provide a refrigerator, in which an ice machine is installed inside a chilling chamber door and a cold air circulation passage is constructed to supply a cold air sufficiently to the ice machine, such that the ice machine can have the same performance as when it is installed in a freezing chamber.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a refrigerator including: a refrigerator body; a blower fan installed in the refrigerant body to blow a cold air; a barrier partitioning an inner space of the refrigerator body into a freezing chamber and a chilling chamber; an ice machine installed in the chilling chamber; a freezing air duct connected with the ice machine, for passing the cold air blown by the blower fan; a chilling air duct connected with the chilling chamber, for passing the cold air blown by the blower fan; a cold air return duct in which the cold air flows after the cold air is discharged from the ice machine; and an evaporator exchanging heat with the cold air discharged from the cold air return duct.

In another aspect of the present invention, there is provided a refrigerator including: a blower fan blowing a cold air; a barrier partitioning an inner space of the refrigerator into a freezing chamber and a chilling chamber; an ice machine installed in a chilling chamber, the ice machine including an ice maker for making an ice, an ice bank for storing the ice made by the ice maker, and an insulating member for accommodating the ice maker and the ice bank; an evaporator exchanging heat with the cold air that is returned from the chilling chamber and/or the freezing chamber; and a cold air circulation passage connecting the blower fan, the ice machine, and the evaporator.

In a further another aspect of the present invention, there is provided a refrigerator including: an evaporator; a blower fan blowing a cold air cooled while passing through the evaporator; an ice machine installed in a chilling chamber of the refrigerator, for freezing water with the cold air blown from the blower fan; and a cold air circulation passage for circulating the cold air along the evaporator, the blower fan, and the ice machine.

According to the present invention, the ice machine is installed inside the door of the chilling chamber, such that a sufficient room can be provided for the freezing chamber.

Further, since the ice machine is installed in the chilling chamber, short users conveniently take out the ice from ice machine.

Furthermore, the cold air circulation passage is formed to supply the cold air smoothly to the ice machine in the chilling chamber, such that the ice machine has the same performance as when it is installed in the freezing chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

[First Embodiment]

Figure 1:
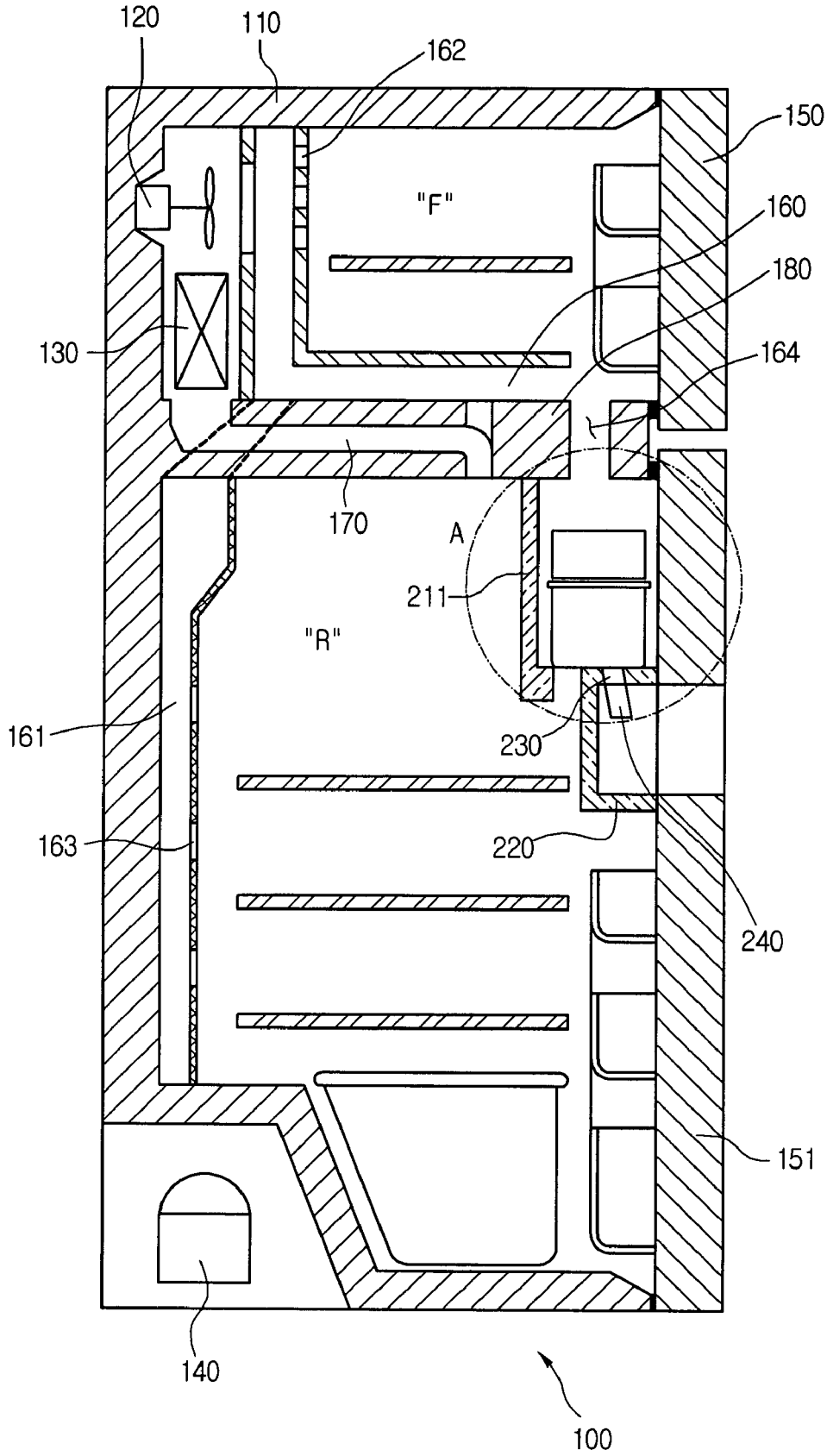
FIG. 1 is a sectional view showing an air circulation structure of a refrigerator according to a first embodiment of the present invention.
Figure 2:
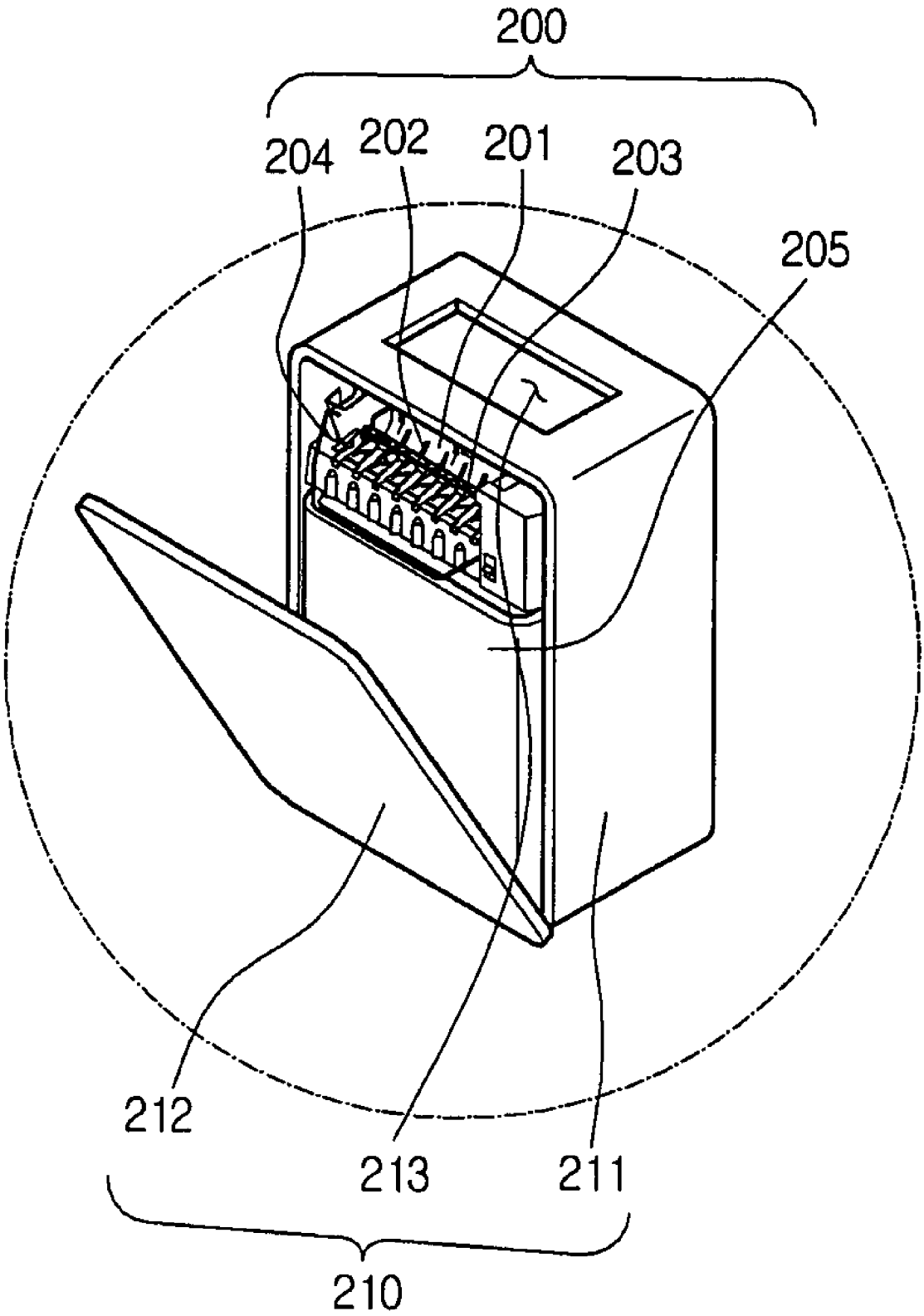
FIG. 2 is an enlarged perspective view of an ice machine depicted at portion "A" in FIG. 1.

FIG. 1 is a sectional view showing an air circulation structure of a refrigerator according to a first embodiment of the present invention, and FIG. 2 is an enlarged perspective view of an ice machine depicted at portion "A" in FIG. 1.

Referring to FIGS. 1 and 2, a refrigerator 100 includes a refrigerator body 110, a freezing chamber door 150, a chilling chamber door 151, a blower fan 120, an evaporator 130, a freezing air duct 160, and a chilling air duct 161. The refrigerator body 110 forms the exterior wall and the frame of the refrigerator 100. The freezing chamber door 150 is hinged to a front upper portion of the refrigerator body 110 for opening and closing a freezing chamber (F), and the chilling chamber door 151 is hinged to a front lower portion of the refrigerator body 110 for opening and closing a chilling chamber (R). The blower fan 120 is installed at a rear portion of the refrigerator body 110 to blow a cold air to the freezing chamber (F) and chilling chamber (R). The evaporator 130 is installed adjacent to the blower fan 120, such that the blower fan 120 can blow a circulation air cooled at the evaporator 130 by a refrigerant. The cold air from the blower fan 120 is directed toward the freezing chamber (F) along the freezing air duct 160, and also directed toward the chilling chamber (R) along the chilling air duct 161.

Further, the refrigerator 100 includes a compressor 140 in which a refrigerant changed to a low-temperature gas at the evaporator 130 is compressed to a high-temperature and high-pressure state. The high-temperature, high-pressure refrigerant is changed to a liquid while passing through a condenser (not shown), and then the pressure and temperature of liquid refrigerant is reduced while the liquid refrigerant passing through an expansion valve (not shown).

Further, the refrigerator 100 includes cold air inflow holes 162 and cold air inflow holes 163. The cold air blown by the blower fan 120 enters the freezing chamber (F) and the chilling chamber (R) through the cold air inflow holes 162 and the cold air inflow holes 163, respectively.

Further, the refrigerator 100 includes an ice maker 200 and an ice-making chamber 210. The ice maker 200 is disposed in the ice-making chamber 210, and the ice-making chamber 210 is installed inside the chilling chamber door 151.

In detail, the ice-making chamber 210 includes an insulating case 211 and an insulating cover 212. The insulating case 211 insulates the ice-making chamber 210 from the chilling chamber (R), and the insulating case 211 covers the front of the insulating case 211. The insulating case 211 includes a cold air inlet 213, a discharge duct (refer to 214 in FIG. 3), a dispenser (refer to 220 in FIG. 3), an ice outlet 230, and ice shoot 240. The cold air inlet 213 is defined at a top of the insulating case 211 to allow the cold air of the freezing chamber (F) to enter the ice-making chamber 210. The discharge duct 214 is defined at a bottom of the insulating case 211 to discharge the cold air from the ice-making chamber 210 to the chilling chamber (R). The dispenser 220 receives ice from the ice maker 200 and of which front is exposed through the chilling chamber door 151 to the outside, such that the user can pick out the ice. The ice outlet 230 and ice shoot 240 are positioned between the ice maker 200 and the dispenser 220 to define a passage there between.

The ice maker 200 is one component of an ice machine making ice with the cold air from the blower fan 120. The ice maker 200 includes a mold 201, an ice bank 205, an ejector 203, and a lever 204. The mold 201 includes a plurality of barrier ribs 202 to define a plurality of freezing compartments. The ice bank 205 has a predetermined size to store the ice ejected by the ejector 203 from the mold 201. The lever 204 detects whether the ice bank 205 is filled with the ice.

Further, the refrigerator 100 includes a barrier 180, a cold air return duct 170, and a guide duct 164. The barrier 180 is horizontally disposed at a predetermined height in the refrigerator body 110 to divide the inside of the refrigerator body 110 into upper and lower chambers, the freezing chamber (F) and chilling chamber (R). The cold air return duct 170 is defined through the barrier 180 to pass the cold air from the chilling chamber (R) to the evaporator 130. The guide duct 164 is formed through the barrier 180 in a vertical direction to connect the freezing air duct 160 and the cold air inlet 213 formed in the insulating case 211 of the ice-making chamber 210.

The refrigeration cycle of the refrigerator 100 will not be described. The evaporator 130 changes the refrigerant from a liquid state to a low-temperature, low-pressure gas state, and then the refrigerant flows to the compressor 140. The compressor 140 compresses the refrigerant to a high temperature and high pressure, and then the refrigerant flows to the condenser (not shown). The condenser changes the refrigerant from the high-temperature, high-pressure gas state to a high-pressure liquid state, and then the liquid-state refrigerant flows to the expansion valve (not shown). The expansion valve decompresses the refrigerant (that is, the refrigerant is adiabatically expanded for an easy evaporation at the evaporator 130), and the decompressed refrigerant flows to the evaporator 130. At the evaporator 130, the refrigerant is evaporated while taking heat from the surrounding circulation air. After that, the evaporated refrigerant (gas state) flows again to the compressor 140.

Meanwhile, the circulation air around the evaporator 130 is cooled by the evaporation of the refrigerant. The blower fan 120 forces the cooled circulation air (cold air) to the freezing chamber (F) and the chilling chamber (R) along the freezing air duct 160 and chilling air duct 161, respectively. The cold air enters the freezing chamber (F) through the cold air inflow holes 162 from the freezing air duct 160, and also enters the chilling chamber (R) through the cold air inflow holes 163 from the chilling air duct 161. Further, the cold air flows along the freezing air duct 160 and enters the ice-making chamber 210 through the cold air inlet 213. The cold air entered the ice-making chamber 210 freezes water in the ice maker 200. Then, the cold air in the ice-making chamber 210 is discharged to the chilling chamber (R). The cold air in the chilling chamber (R) flows back to the evaporator 130. In this way, the cold air is circulated in the refrigerator 100.

Figure 3:
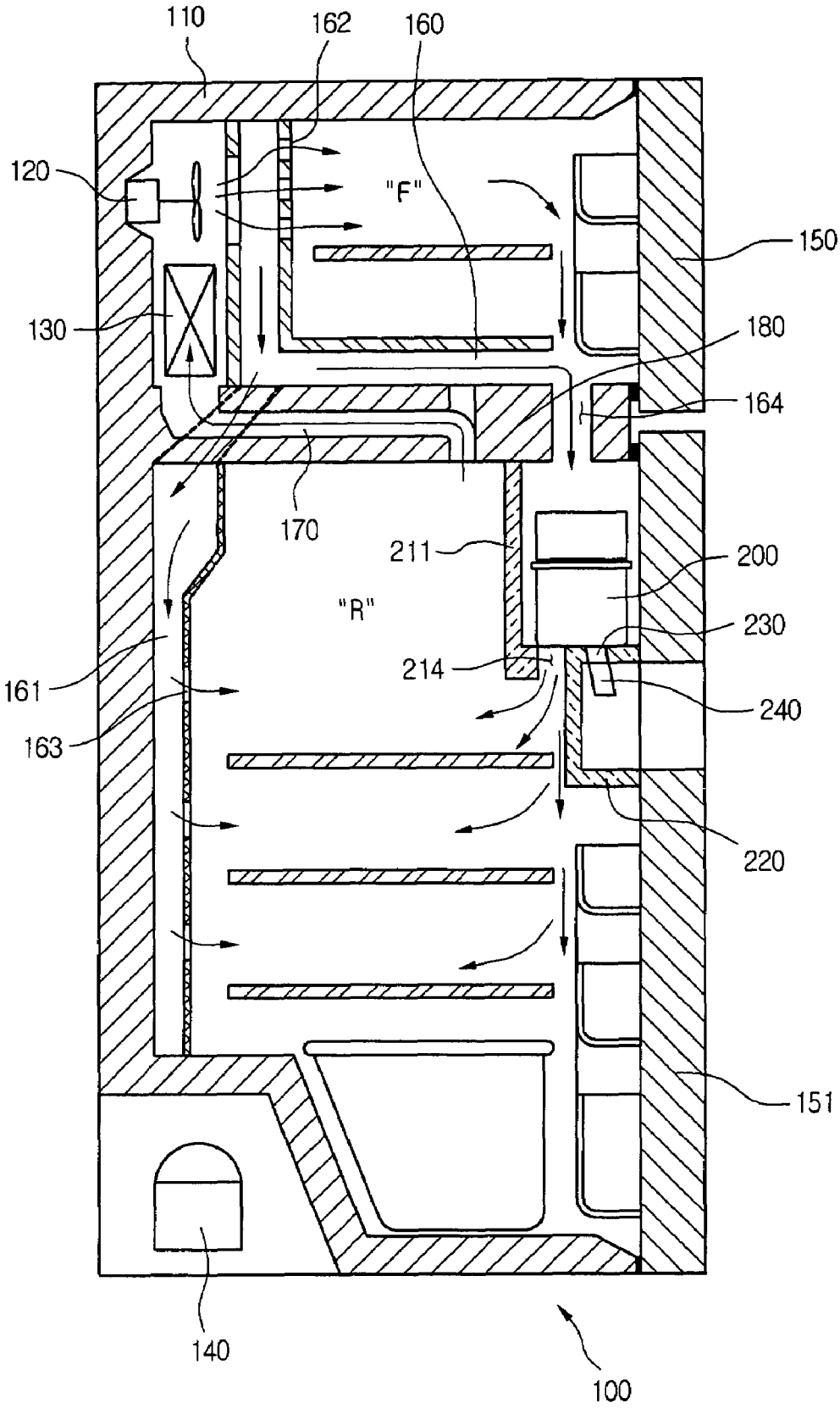
FIG. 3 is a sectional view showing an air circulation in the refrigerator depicted in FIG. 1.

FIG. 3 is a sectional view showing an air circulation in the refrigerator depicted in FIG. 1.

Referring to FIG. 3, a circulation air in the refrigerator 100 is cooled at the evaporator 130, and the cooled air (cold air) is circulated through the refrigerator 100 by the driving force of the blower fan 120.

The cold air blown by the blower fan 120 is selectively directed to the freezing air duct 160 or the chilling air duct 161 branched off from the freezing air duct 160, according to a control of a damper (not shown). Some of the cold air directed to the freezing air duct 160 passes to the freezing chamber (F) through the cold air inflow holes 162, and some of the rest passes through the freezing air duct 160 to enter the ice-making chamber 210 through the guide duct 164 and the cold air inlet 213. The cold air entered the ice-making chamber 210 takes heat from water in the ice maker 200 to freeze the water. The cold air in the ice-making chamber 210, of which temperature is increased for freezing the water, is discharged to the chilling chamber (R) through the discharge duct 214 formed at the bottom of the insulating case 211. The ice made at the ice maker 200 by the cold air is stored in the ice bank 205. The ice stored in the ice bank 205 is discharged to the dispenser 220 through the ice outlet 230 and ice shoot 240, upon the user's take-out operation.

Meanwhile, the cold air entered the chilling chamber (R) through the cold air inflow holes 163 and discharge duct 214 is circulated to cool food. After cooling the food, the cold air goes back to the evaporator 130 along the cold air return duct 170. The returned cold air exchanges heat with the refrigerant of the evaporator 130 and thereby is cooled again.

Meanwhile, the cold air entered the freezing chamber (F) through the cold air inflow holes 162 is circulated through the freezing chamber (F) and discharged to the ice-making chamber 210 through the guide duct 164.

[Second Embodiment]

Figure 4:
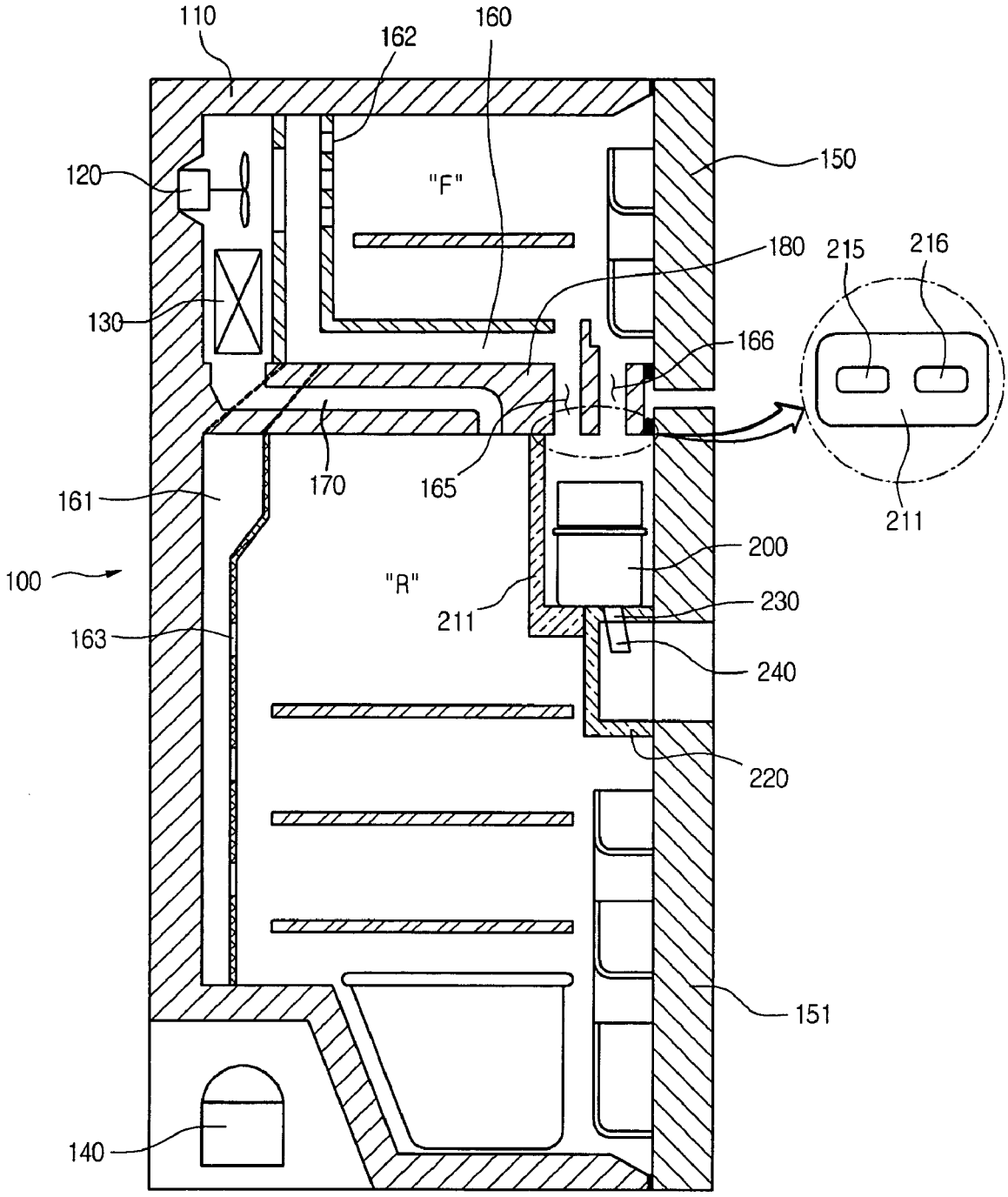
FIG. 4 is a sectional view showing an air circulation structure of a refrigerator according to a second embodiment of the present invention.
Figure 5:
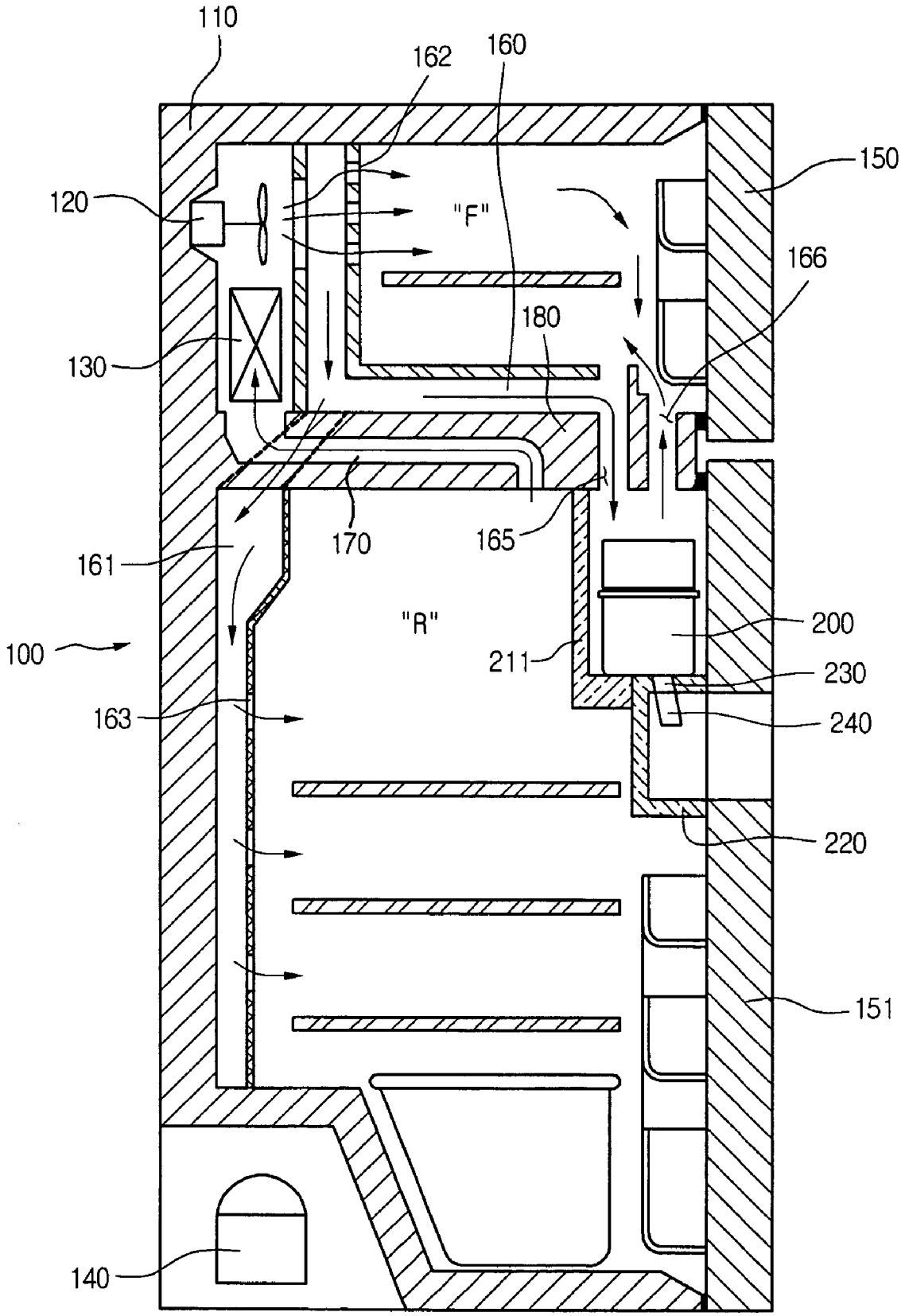
FIG. 5 is a sectional view showing an air circulation in the refrigerator depicted in FIG. 4.

FIG. 4 is a sectional view showing an air circulation structure of a refrigerator according to a second embodiment of the present invention, and FIG. 5 is a sectional view showing an air circulation in the refrigerator depicted in FIG. 4.

Referring to FIGS. 4 and 5, a refrigerator 100 includes a freezing air duct 160, a chilling air duct 161, an inlet duct 165, an outlet duct 166, and a cold air return duct 170. A cold air blown by a blower fan 120 passes along the freezing air duct 160. The chilling air duct 161 is branched off from the freezing air duct 160 and connected to a chilling chamber (R). The inlet duct 165 is formed through a barrier 180 to connect an end of the freezing air duct 160 to an ice-making chamber 210 (refer to FIG. 2). The outlet duct 166 is formed through the barrier 180 in a vertical direction to allow a cold air circulated in the ice-making chamber 210 to enter a freezing chamber (F). The cold air return duct 170 is formed in the barrier 180 to allow a cold air circulated in the chilling chamber (R) to go back to an evaporator 130.

The ice-making chamber 210 includes an insulating case 211. The insulating case insulating case 211 includes a cold air inflow hole 215 and a cold air discharge hole 216 at its top that are respectively communicated with the inlet duct 165 and the outlet duct 166, such that a cold air can enter the ice-making chamber 210 through the inlet duct 165 from the freezing air duct 160 and can exit the ice-making chamber 210 through the outlet duct 166 toward the freezing chamber (F). Descriptions for other elements of the refrigerator 100 will be omitted because they are the same as the first embodiment.

A cold air circulation in the refrigerator 100 will be described.

Some of a cold air blown by the blower fan 120 flows along the freezing air duct 160, and some of the rest flows along the chilling air duct 161 according to a control of a damper (not shown). Some of the cold air of the freezing air duct 160 enters the freezing chamber (F) through cold air inflow holes 162 and some of the rest flows along the freezing air duct 160 to enter the ice-making chamber 210 through the inlet duct 165. The cold air entered the ice-making chamber 210 freezes water in an ice maker 200, and the cold air of which temperature is increased while freezing the water is discharged to the freezing chamber (F) through the outlet duct 166. In the freezing chamber (F), the cold air discharged from the ice-making chamber 210 and the cold air entered through the cold air inflow holes 162 are mixed with each other.

The cold air of the chilling air duct 161 enters the freezing chamber (F) through cold air inflow holes 163. The cold air entered the chilling chamber (R) makes food cool and then returns to the evaporator 130 along the cold air return duct 170. At the evaporator 130, the returned cold air is cooled again as described with reference to FIG. 3.

[Third Embodiment]

Figure 6:
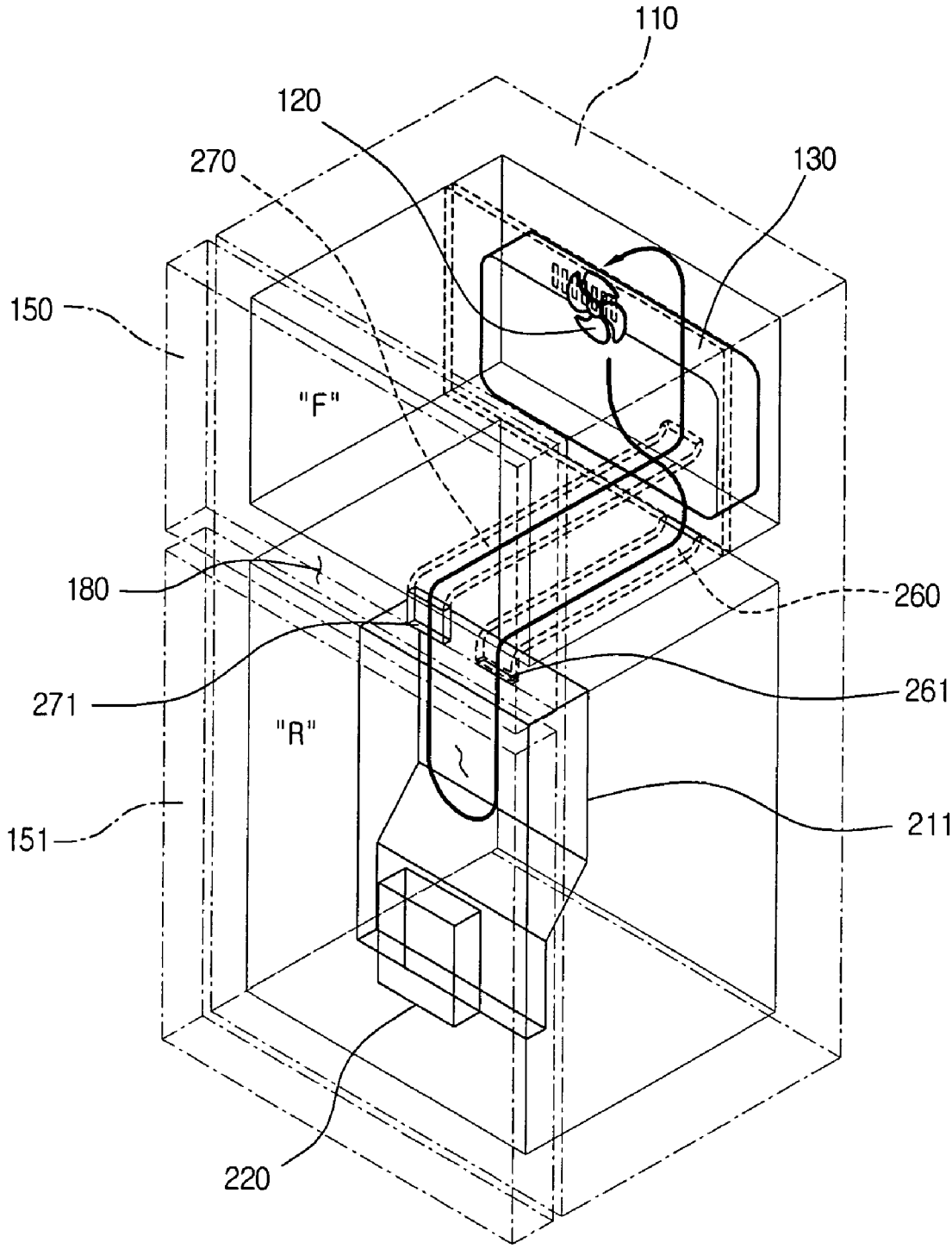
FIG. 6 is a perspective view showing an air circulation structure of a refrigerator according to a third embodiment of the present invention.
Figure 7:
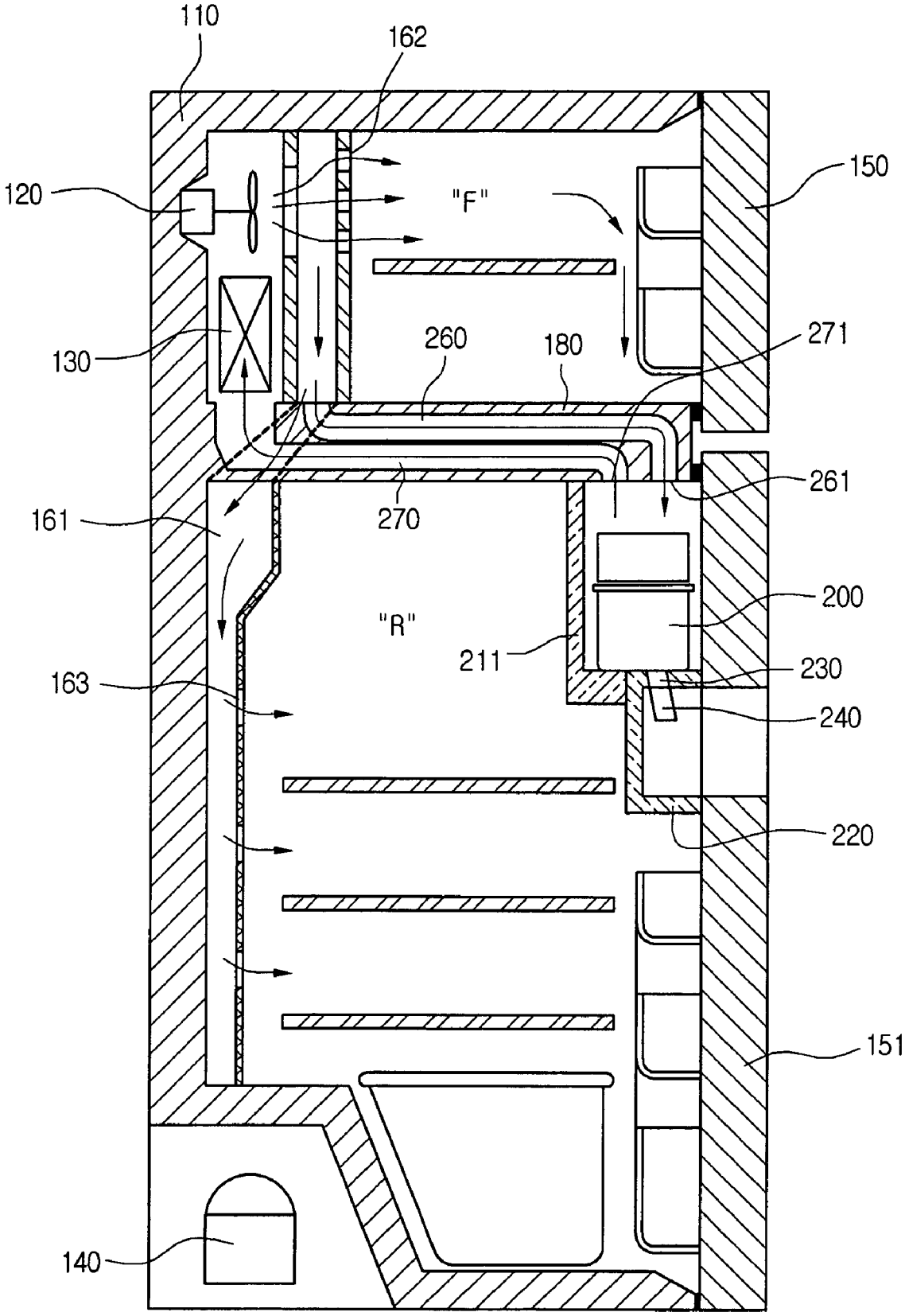
FIG. 7 is a sectional view showing an air circulation in the refrigerator depicted in FIG. 6.

FIG. 6 is a perspective view showing an air circulation structure of a refrigerator according to a third embodiment of the present invention, and FIG. 7 is a sectional view showing an air circulation in the refrigerator depicted in FIG. 6.

Referring to FIGS. 6 and 7, a refrigerator 100 includes a barrier 180, a freezing air duct 260, a cold air return duct 270, and a chilling air duct 161. The barrier 180 divides the inner space of the refrigerator 100 into upper and lower chambers, a freezing chamber (F) and a chilling chamber (R). The freezing air duct 260 is extended through the barrier 180 and connected to a top of an insulating case 211 of an ice-making chamber 210 (refer to FIG. 2). The cold air return duct 270 is formed through the barrier 180 to allow a cold air in the ice-making chamber 210 to go back to an evaporator 130. The chilling air duct 161 allows a cold air blown by a blower fan 120 to flow toward the chilling chamber (R).

The insulating case 211 includes a cold air inflow hole 261 and a cold air discharge hole 271 at its top, which are connected with the freezing air duct 260 and the cold air return duct 270, respectively.

Since other elements of the refrigerator 100 are the same as described above, their descriptions will be omitted.

A cold air circulation in the refrigerator 100 will be described.

Some cold air blown by the blower fan 120 directly enters the freezing chamber (F) through cold air inflow holes 162, and some of the rest flows along the freezing air duct 260 to enter the ice-making chamber 210. The cold air entered the ice-making chamber 210 freezes water in an ice maker 200, and the cold air of which temperature is increased while freezing the water is discharged to the cold air return duct 270 through the cold air discharge hole 271. The cold air in the cold air return duct 270 returns to the evaporator 130. At the evaporator 130, the returned cold air is cooled again while exchanging heat with a refrigerant in the evaporator 130, and then is circulated again in the refrigerator 100 by the driving force of the blower fan 120.

[Fourth Embodiment]

Figure 8:
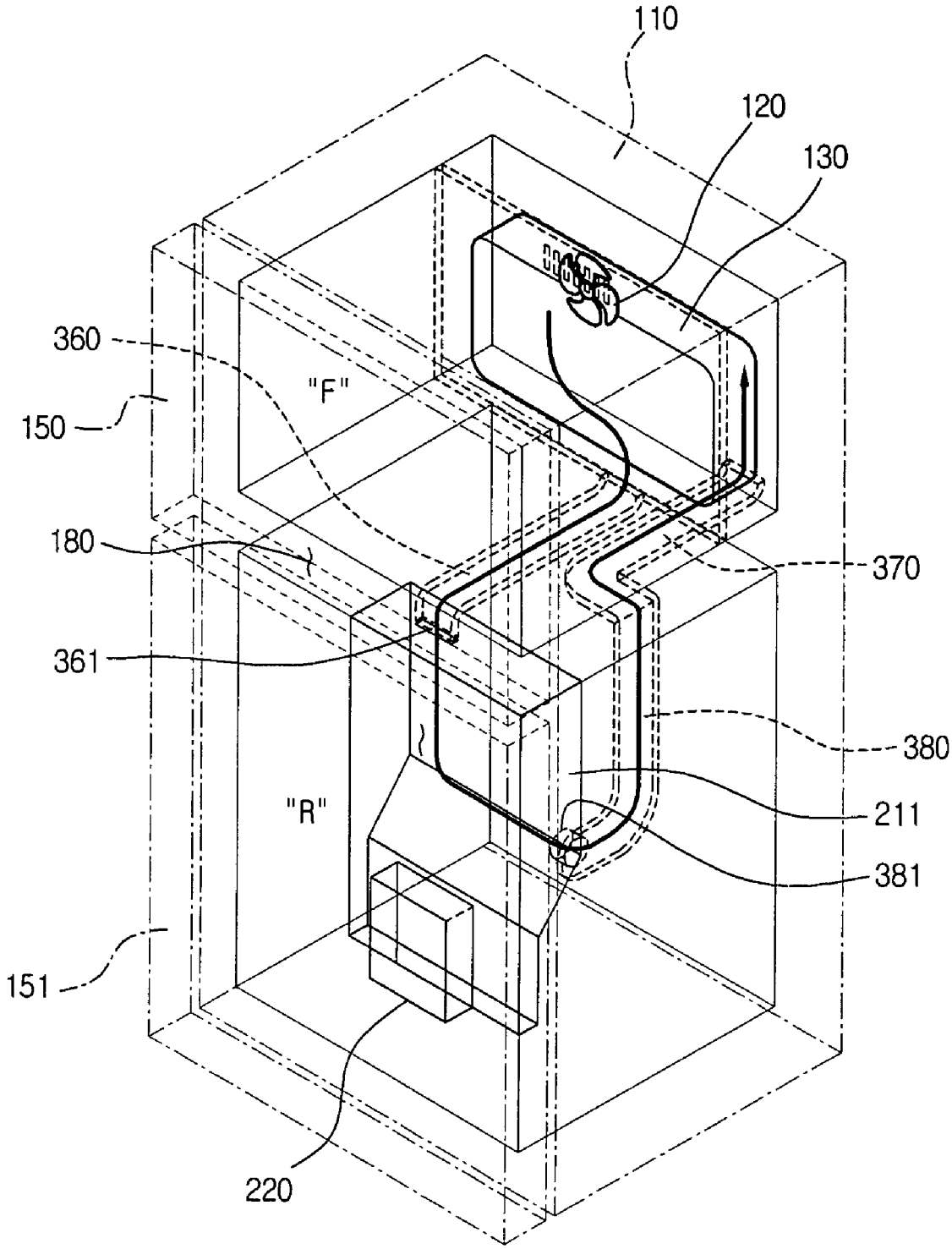
FIG. 8 is a perspective view showing an air circulation structure of a refrigerator according to a fourth embodiment of the present invention.
Figure 9:
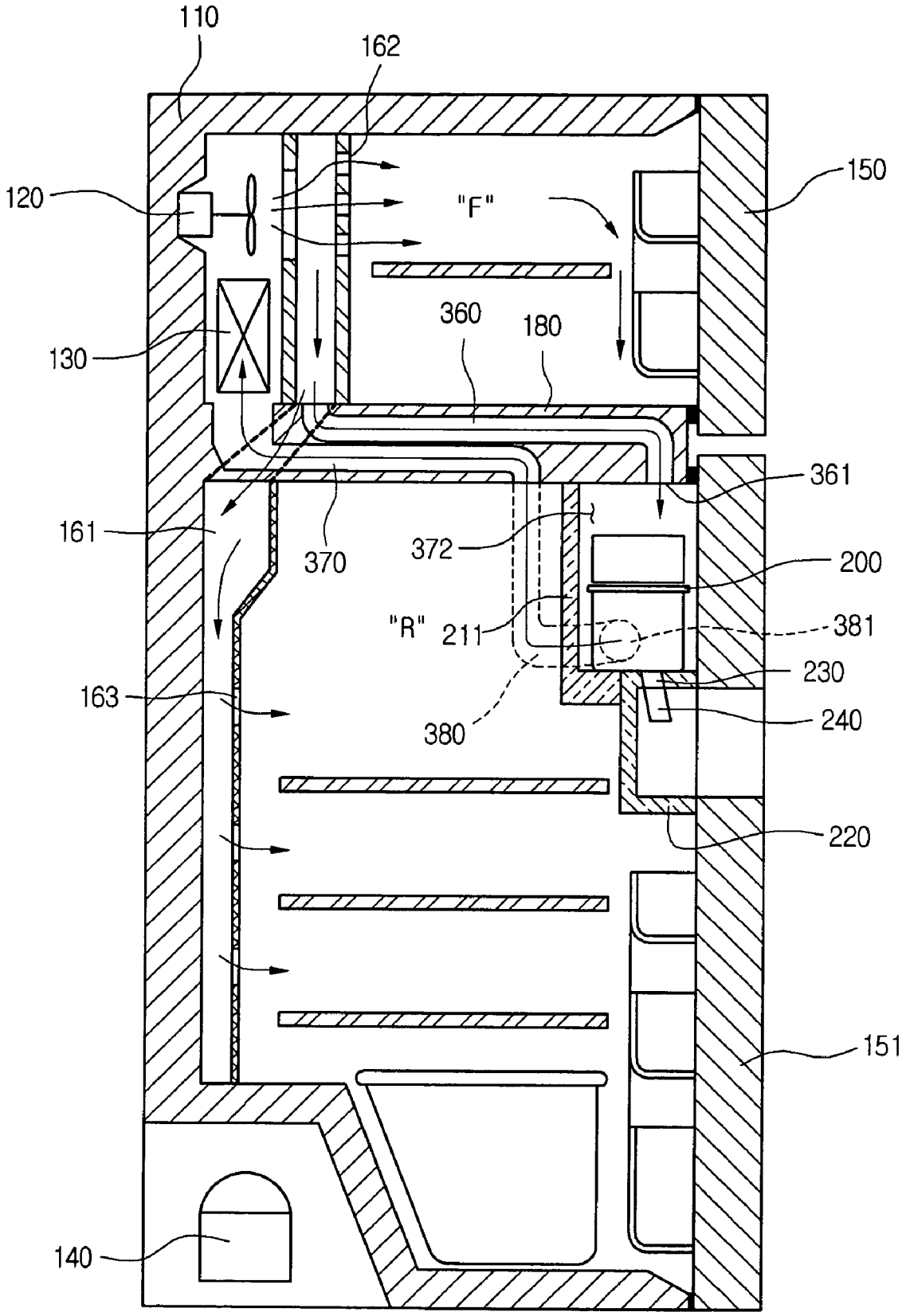
FIG. 9 is a sectional view showing an air circulation in the refrigerator depicted in FIG. 8.

FIG. 8 is a perspective view showing an air circulation structure of a refrigerator according to a fourth embodiment of the present invention, and FIG. 9 is a sectional view showing an air circulation in the refrigerator depicted in FIG. 8.

Referring to FIGS. 8 and 9, a refrigerator 100 includes a barrier 180, a freezing air duct 360, a cold air return duct 370, and a connecting duct 380, and a chilling air duct 161. The barrier 180 divides the inner space of the refrigerator 100 into upper and lower chambers, an upper freezing chamber (F) and a lower chilling chamber (R). The freezing air duct 360 is extended through the barrier 180 and connected to a top of an insulating case 211 of an ice-making chamber 210 (refer to FIG. 2). The cold air return duct 370 is formed through the barrier 180 to allow a cold air in the ice-making chamber 210 to go back to an evaporator 130. The connecting duct 380 includes an end connected to the ice-making chamber 210 and the other end connected to the cold air return duct 370. The chilling air duct 161 allows a cold air blown by a blower fan 120 to flow toward the chilling chamber (R).

In detail, the connecting duct 380 is formed along an inner surface of the chilling chamber (R) to the cold air return duct 370, and a cold air discharge hole 381 is formed at a side of the insulating case 211 for connecting the connecting duct 380 and the ice-making chamber 210. Also, the insulating case 211 includes a cold air inflow hole 361 at its top, for connecting an end of the freezing air duct 360 to the ice-making chamber 210.

A cold air circulation in the refrigerator 100 will be described.

The blower fan 120 blows a cold air toward cold air inflow holes 162, the freezing air duct 360, and the chilling air duct 161. The cold air blown to the cold air inflow holes 162 enters the freezing chamber (F), and the cold air blown to the freezing air duct 360 passes through the cold air inflow hole 361 of the insulating case 211 to enter the ice-making chamber 210. The cold air entered the ice-making chamber 210 is circulated through the ice-making chamber 210 to freeze water, and then discharged to the connecting duct 380 through the cold air discharge hole 381. The discharged cold air flows along the connecting duct 380 and the cold air return duct 370 toward the evaporator 130. That is, the cold air blown by the blower fan 120 to the freezing air duct 360 is circulated through the ice-making chamber 210, the connecting duct 380, the cold air return duct 370, the evaporator 130, and returned to blower fan 120. Meanwhile, the cold air blown to the chilling air duct 161 enters the chilling chamber (R) through cold air inflow holes 163.

[Fifth Embodiment]

Figure 10:
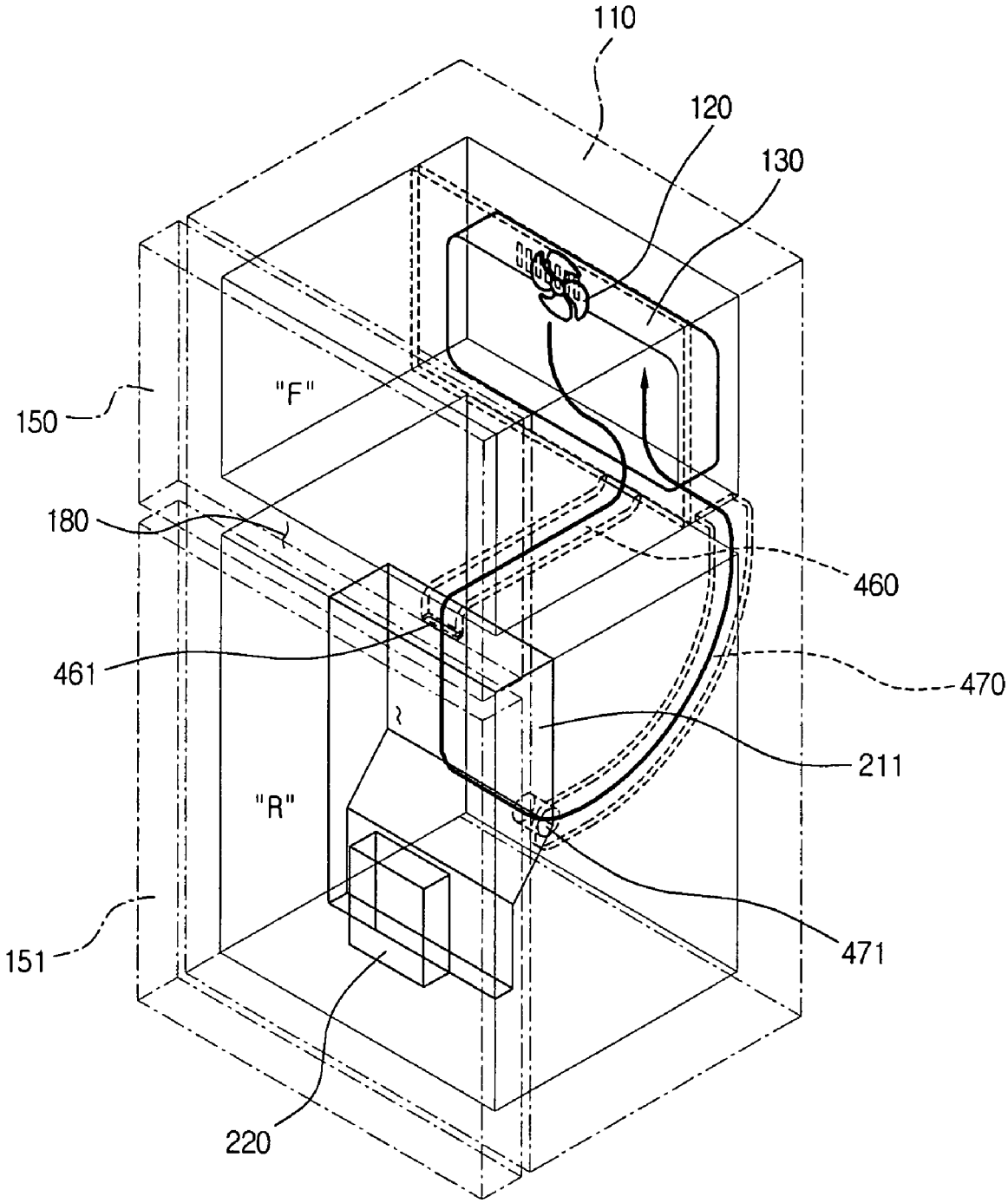
FIG. 10 is a perspective view showing an air circulation structure of a refrigerator according to a fifth embodiment of the present invention.
Figure 11:
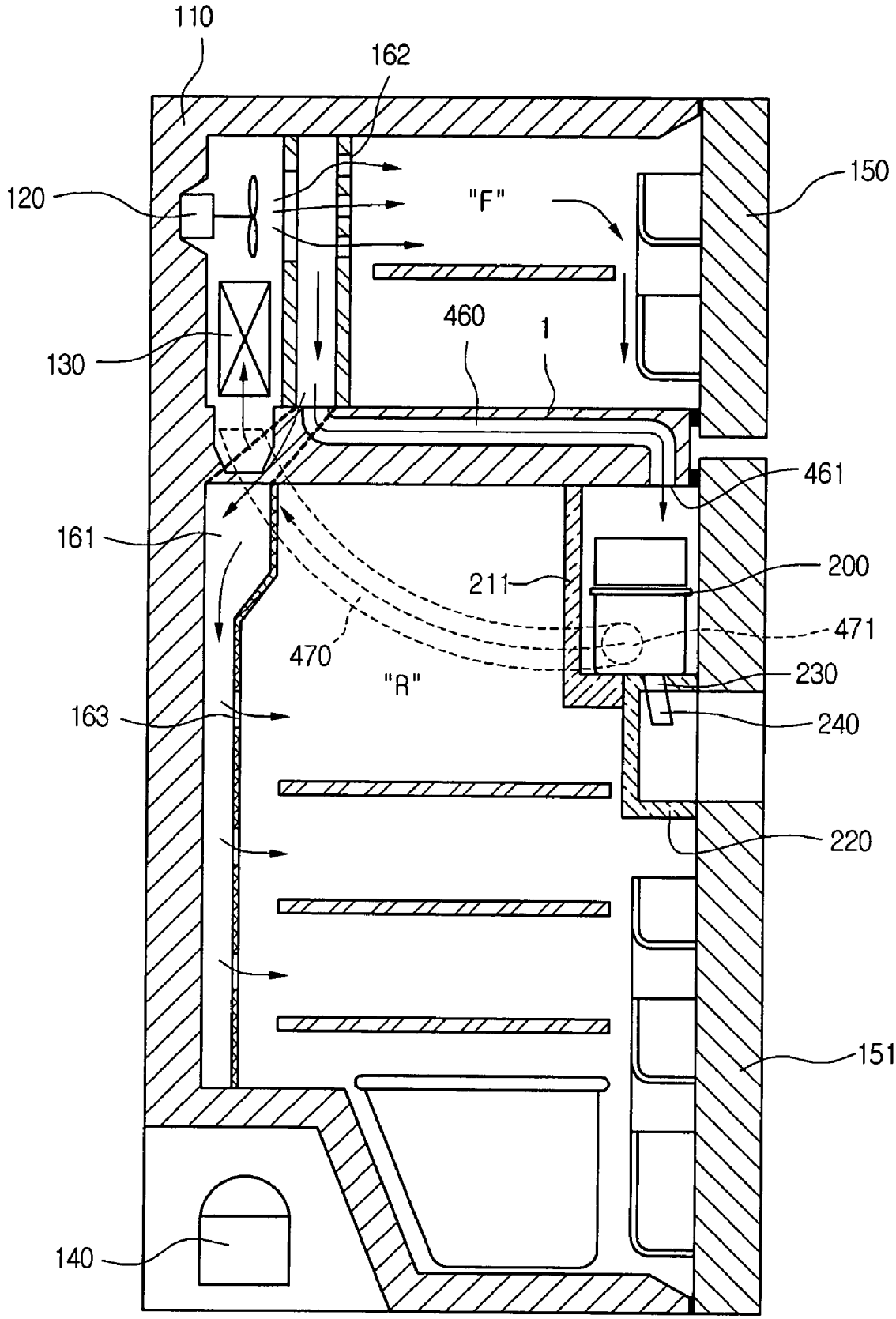
FIG. 11 is a sectional view showing an air circulation in the refrigerator depicted in FIG. 10.

FIG. 10 is a perspective view showing an air circulation structure of a refrigerator according to a fifth embodiment of the present invention, and FIG. 11 is a sectional view showing an air circulation in the refrigerator depicted in FIG. 10.

Referring to FIGS. 10 and 11, a refrigerator 100 includes a blower fan 120, a freezing air duct 460, an ice-making chamber 210 (refer to FIG. 2), an ice maker 200, a cold air discharge duct 471, and a cold air return duct 470. The blower fan 120 blows a cold air. The barrier 180 divides the inner space of the refrigerator 100 into two chambers, a freezing chamber (F) and a chilling chamber (R). The freezing air duct 460 is formed through the barrier 180. The ice-making chamber 210 is installed inside a chilling chamber door 151, and the freezing air duct 460 is connected to the ice-making chamber 210. The ice maker 200 is installed in the ice-making chamber 210. The cold air discharge duct 471 is formed at a side of the ice-making chamber 210. The cold air return duct 470 is formed along an inner surface of the chilling chamber (R) to connect the cold air discharge duct 471 and the evaporator 130. Also, the refrigerator 100 includes a chilling air duct 161 and cold air inflow holes 163. The chilling air duct 161 is formed at a back of the chilling chamber (R) to allow a cold air blown by the blower fan 120 to pass therethrough. Through the cold air inflow holes 163, the cold air in the chilling air duct 161 enters the chilling chamber (R).

A cold air circulation in the refrigerator 100 will be described.

While passing through the evaporator 130, a circulation air is cooled. The blower fan 120 blows the cold air toward the freezing chamber (F) and the chilling chamber (R).

Some of the cold air blown by the blower fan 120 directly enters the freezing chamber (F) through cold air inflow holes 162, and the rest flows along the freezing air duct 460 and the chilling air duct 161 branched off the freezing air duct 460.

The cold air flowing along the freezing air duct 460 is directed to the ice-making chamber 210 through a cold air inflow hole 461 formed at a top of the insulating case 211. The cold air entered the ice-making chamber 210 is circulated through the ice-making chamber 210 to take heat form water in the ice-making chamber 210 to freeze the water, and then the cold air of which temperature is increased is discharged to the cold air return duct 470 through the cold air discharge duct 471. The discharged cold air flows along the cold air return duct 470 toward the evaporator 130.

In the exemplary embodiments described above, the air circulation structure of the present invention is applied to the top mount refrigerator. However the cold air circulation structure can be applied to various types of refrigerators, for example, a side-by-side refrigerator having chilling and freezing chambers right and left, and a bottom freezer refrigerator having chilling and freezing chambers up and down.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a refrigerator body;

a blower fan installed in the refrigerant body to blow a cold air;

a barrier partitioning an inner space of the refrigerator body into a freezing chamber and a chilling chamber;

an ice machine installed in the chilling chamber;

a freezing air duct connected with the ice machine, for passing the cold air blown by the blower fan;

a chilling air duct connected with the chilling chamber, for passing the cold air blown by the blower fan;

a cold air return duct in which the cold air flows after the cold air is discharged from the ice machine; and an evaporator exchanging heat with the cold air discharged from the cold air return duct.

2. The refrigerator according to claim 1, wherein the freezing air duct is formed at a top of the barrier.

3. The refrigerator according to claim 1, further comprising:

a guide duct formed through the barrier to connect the freezing air duct with the ice machine; and a discharge duct formed at a predetermined portion of the ice machine to discharge the cold air of the ice machine to the chilling chamber.

4. The refrigerator according to claim 1, wherein the cold air return duct is formed in the barrier.

5. The refrigerator according to claim 1, wherein an end of the cold air return duct is connected with the chilling chamber.

6. The refrigerator according to claim 1, wherein the ice machine is installed inside a door of the chilling chamber.

7. The refrigerator according to claim 1, wherein the ice machine includes:

an ice maker making an ice;

an ice bank storing the ice made by the ice maker; and an ice-making chamber accommodating the ice maker and the ice bank.

8. The refrigerator according to claim 7, wherein the ice-making chamber includes;

an insulating case; and an insulating cover for insulating the insulating case from a door of the chilling chamber.

9. The refrigerator according to claim 7, wherein the ice-making chamber includes a cold air inflow hole and/or a cold air discharge hole.

10. The refrigerator according to claim 1, wherein the ice machine includes:

an ice outlet for discharging an ice out of the refrigerator;

an ice shoot connected with the ice outlet; and a dispenser for receiving the ice discharged through the ice shoot.

11. The refrigerator according to claim 1, further comprising an outlet duct formed through the barrier, for passing the cold air from the ice machine to the freezing chamber.

12. The refrigerator according to claim 1, wherein the freezing air duct is formed in the barrier.

13. The refrigerator according to claim 7, wherein the cold air return duct includes:

one end connected to the ice-making chamber; and the other end connected to the evaporator.

14. The refrigerator according to claim 7, further comprising a connecting duct for connecting the ice-making chamber and the cold air return duct.

15. The refrigerator according to claim 14, wherein the connecting duct is formed along an inner surface of the chilling chamber.

16. The refrigerator according to claim 14, further comprising a cold air discharge hole and/or a cold air discharge duct, for connecting the ice-making chamber and the connecting duct.

17. The refrigerator according to claim 1, wherein the cold air return duct includes:

one end connected to a side of the ice machine;

the other end connected to the evaporator; and a body portion formed along an inner surface of the chilling chamber.

* * * * *

UNITED STATES PATENT AND TRADEMARK OFFICE

CERTIFICATE OF CORRECTION

PATENT NO. : 7,240,510 B2
APPLICATION NO. : 10/043045
DATED : July 10, 2007
INVENTOR(S) : Myung Ryul Lee et al.

It is certified that error appears in the above-identified patent and that said Letters Patent is hereby corrected as shown below:

In the Abstract:

On line 2, “refrigerant” should read --refrigerator--.

On line 2, “a cold air” should read --cold air--.

In the Specification:

In Column 2, line 25, “refrigerant” should read --refrigerator--.

In Column 2, line 25, “a cold air” should read --cold air--.

In Column 3 , line 63, “a cold air” should read --cold air--.

In Column 4, line 30, “ice shoot” should read --ice chute--.

In Column 4, line 39, “ice shoot” should read --ice chute--.

In Column 5, line 52, “ice shoot” should read --ice chute--.

In Column 9, line 7, “refrigerant” should read --refrigerator--.

In Column 9, lines 7-8, “a cold air” should read --cold air--.

In Column 9, line 18, “evaporator exchanging” should read --evaporator for exchanging--.

In Column 9, line 38, “ice maker making” should read --ice maker for making--.

In Column 9, line 39, “ice bank storing” should read --ice bank for storing--.

In Column 9, line 40, “ice-making chamber accommodating” should read --ice-making chamber for accommodating--.

UNITED STATES PATENT AND TRADEMARK OFFICE

CERTIFICATE OF CORRECTION

PATENT NO. : 7,240,510 B2
APPLICATION NO. : 10/043045
DATED : July 10, 2007
INVENTOR(S) : Myung Ryul Lee et al.

It is certified that error appears in the above-identified patent and that said Letters Patent is hereby corrected as shown below:

In the Specification:

In Column 10, line 11, "discharging an ice" should read --discharging ice--.

In Column 10, line 12, "ice shoot" should read --ice chute--.

In Column 10, line 14, "ice shoot" should read --ice chute--.

Signed and Sealed this

Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,240,510 B2
APPLICATION NO. : 11/043045
DATED : July 10, 2007
INVENTOR(S) : Myung Ryul Lee et al.

It is certified that error appears in the above-identified patent and that said Letters Patent is hereby corrected as shown below:

In the Abstract:

On line 2, "refrigerant" should read --refrigerator--.

On line 2, "a cold air" should read --cold air--.

In the Specification:

In Column 2, line 25, "refrigerant" should read --refrigerator--.

In Column 2, line 25, "a cold air" should read --cold air--.

In Column 3, line 63, "a cold air" should read --cold air--.

In Column 4, line 30, "ice shoot" should read --ice chute--.

In Column 4, line 39, "ice shoot" should read --ice chute--.

In Column 5, line 52, "ice shoot" should read --ice chute--.

In Column 9, line 7, "refrigerant" should read --refrigerator--.

In Column 9, lines 7-8, "a cold air" should read --cold air--.

In Column 9, line 18, "evaporator exchanging" should read --evaporator for exchanging--.

In Column 9, line 38, "ice maker making" should read --ice maker for making--.

In Column 9, line 39, "ice bank storing" should read --ice bank for storing--.

In Column 9, line 40, "ice-making chamber accommodating" should read --ice-making chamber for accommodating--.

In the Specification:

In Column 10, line 11, "discharging an ice" should read --discharging ice--.

In Column 10, line 12, "ice shoot" should read --ice chute--.

In Column 10, line 14, "ice shoot" should read --ice chute--.

This certificate supersedes the Certificate of Correction issued November 10, 2009.

Signed and Sealed this

Nineteenth Day of January, 2010

David J. Kappos

David J. Kappos
*Director of the United States Patent and Trademark Office*